United States Patent [19]

Walters

[11] 4,149,504

[45] Apr. 17, 1979

[54] CANISTER FUEL BOWL VENT VALVE

[75] Inventor: Leslie K. Walters, Rochester, Mich.

[73] Assignee: General Motors Corporation, Detroit, Mich.

[21] Appl. No.: 815,260

[22] Filed: Jul. 13, 1977

[51] Int. Cl.[2] ..... F02M 33/02

[52] U.S. Cl. ..... 123/136; 137/DIG. 8

[58] Field of Search ..... 123/136; 137/66, DIG. 8

[56] References Cited

U.S. PATENT DOCUMENTS

| | | | |
|---|---|---|---|
| 2,332,108 | 10/1943 | Paille | 137/66 |
| 3,618,909 | 11/1971 | Toda et al. | 123/136 |
| 3,703,165 | 11/1972 | Hansen | 123/136 |
| 3,935,850 | 2/1976 | King | 123/136 |
| 4,016,848 | 4/1977 | Nagai | 123/136 |

*Primary Examiner*—Charles J. Myhre

*Assistant Examiner*—Andrew M. Dolinar

*Attorney, Agent, or Firm*—Arthur N. Krein

[57] ABSTRACT

In a fuel vapor recovery system for an internal combustion engine, a canister fuel bowl vent valve is provided with a normally open valve element to control flow in a vent passage between the carburetor fuel bowl and a vapor storage canister, the valve element being responsive to engine vacuum to effect closing movement thereof whereby to block the flow of fuel vapors from the fuel bowl to the canister and, an electrical switch, responsive to engine oil pressure, energizes a solenoid which holds the valve element in a closed position, after it has been moved to a closed position in response to engine vacuum, whereby full venting of fuel vapors from the carburetor fuel bowl to the canister occurs only when the engine is not in operation.

2 Claims, 2 Drawing Figures

CANISTER FUEL BOWL VENT VALVE

Figure 1:
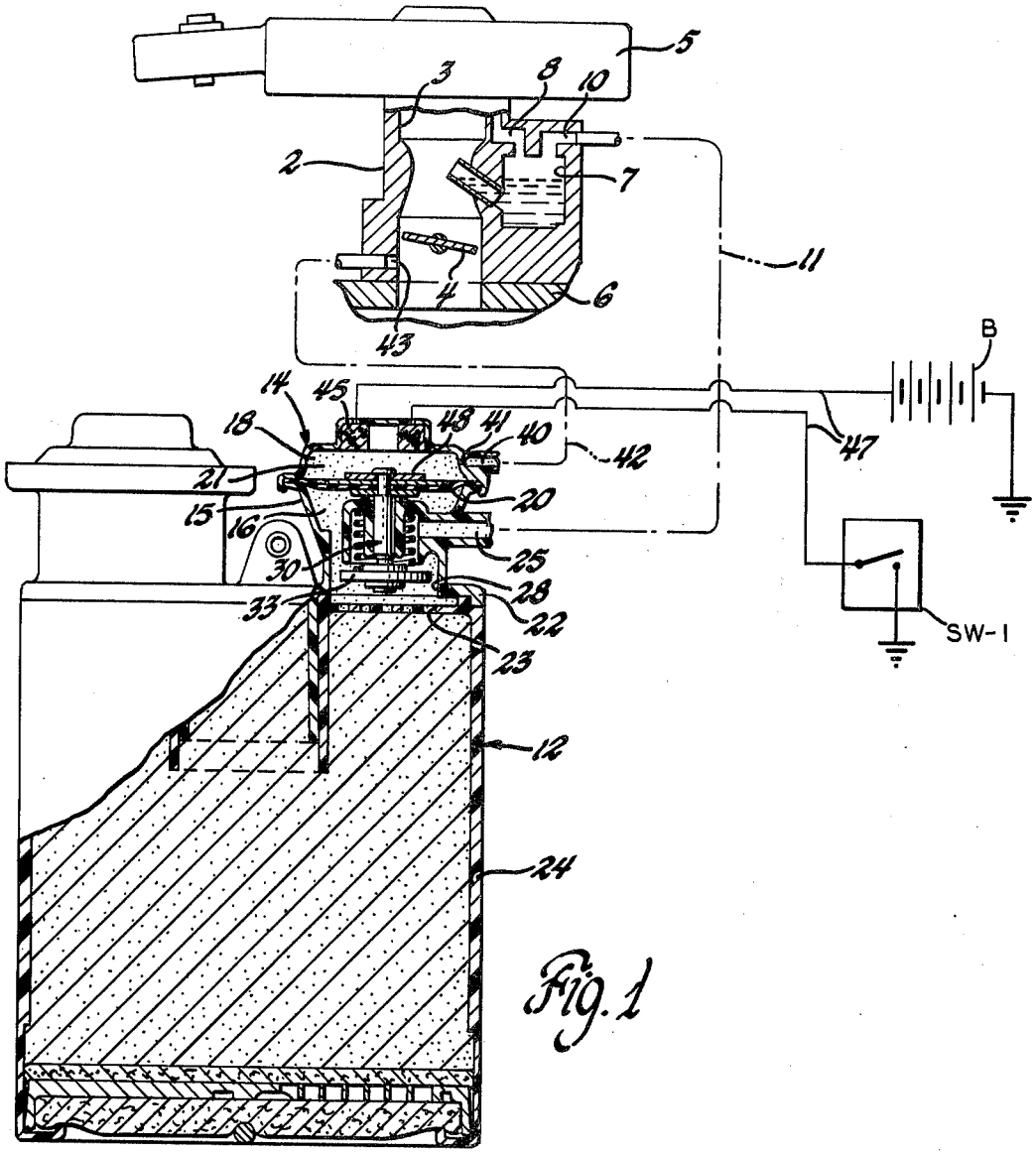

This invention relates to a fuel vapor recovery system, also called an evaporative emission control system, for an internal combustion engine and, in particular, to a fuel bowl vent valve for use in such a system to control the venting of fuel vapors from the carburetor fuel bowl to a vapor storage canister in such a system.

In recent years, many vehicles have been equipped with a fuel vapor recovery system of the type in which a vapor storage canister is used to receive and store fuel vapors emitted from the fuel tank of the vehicle. During engine operation, the fuel vapor stored in such a canister has been purged, as controlled, for example, by a suitable purge control valve, either into the air cleaner or carburetor for induction into the vehicle engine whereby such fuel vapors are consumed therein.

In some of the aforementioned vehicles, the fuel vapor storage canister is also used to receive fuel vapors from the fuel bowl of the carburetor associated with the vehicle engine. In such systems, the fuel vapors from the fuel bowl are selectively vented either to the fuel vapor storage canister or into the induction fluid flow path to the engine for consumption therein as controlled by a switch or vent valve operated either by manifold vacuum or by linkage from the throttle, or both. Preferably, during engine operation, the fuel vapors from the fuel bowl are vented directly into the induction flow stream to the combustion chambers of the engine for consumption therein whereas, when the engine is not operating, these fuel vapors are vented to the vapor storage canister so that the next time the engine is operated, such fuel vapors, as stored in the canister, will then be purged therefrom into the engine induction system.

However, in such a fuel bowl venting system as described above, when the vent valve is of the type operated by manifold vacuum, if such vent valve is calibrated for proper operation at substantially sea level, then at altitude, the vent valve, does not operate satisfactorily because pressure differentials across opposite sides of the diaphragm actuating the valve tend to decrease substantially at higher engine loads whereby such valve is not operative in the same manner as at sea level to control vapor flow.

Accordingly, it is the primary object of this invention to improve a canister fuel bowl vent valve structure whereby such structure is operative at all altitudes to control the flow of fuel vapors from a carburetor fuel bowl to a fuel vapor storage canister or to permit the flow of fuel vapors into the induction fluid flow path to the combustion chamber of an engine.

Another object of this invention is to improve a canister fuel bowl vent valve by the incorporation therein of an electromagnetic arrangement whereby, during engine operation, as the control valve is moved to a closed position as a function of engine vacuum, the electromagnet is operative to retain the valve in such closed position during continued engine operation irrespective of fluctuations in engine manifold vacuum.

These and other objects of the invention are obtained in a canister fuel bowl vent valve that includes a housing defining a cavity which is separated by a diaphragm to form on one side thereof a vacuum chamber that is in fluid communication with the induction system for an engine at a position downstream of the throttle valve controlling flow therethrough and a flow chamber on the opposite side thereof, the housing having an inlet to the flow chamber that is connected to the fuel bowl of a carburetor in position to receive fuel vapors therein and having an outlet from the flow chamber that is in communication with a fuel vapor storage canister, flow between the inlet and outlet being controlled by a valve element fixed at one end to the diaphragm and which is normally biased by a spring to an open position permitting flow from the inlet to the outlet, the valve housing supporting the coil of an electromagnet while the valve diaphragm assembly has a magnetic attractable armature fixed thereto, the coil being sized so as to provide insufficient force to attract the armature against the biasing action of the spring but providing sufficient holding force to hold the armature in position to maintain the valve element in a closed position once engine vacuum is sufficient to effect movement of the diaphragm to cause movement of the valve element from its normally open position to a closed position blocking flow through the flow chamber from the inlet to the outlet, the coil being energized during engine operation via an engine oil pressure actuated switch.

Figure 2:
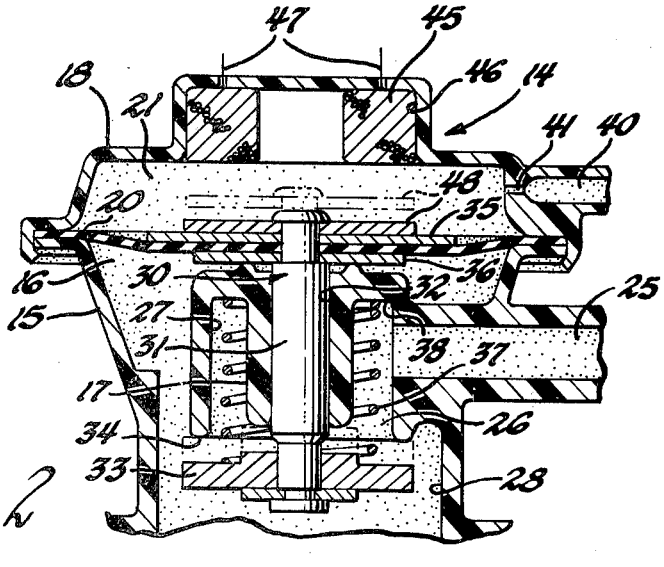

For a better understanding of the invention, as well as other objects and further features thereof, reference is had to the following detailed description of the invention to be read in connection with the accompanying drawings, wherein:

FIG. 1 is a schematic view of a portion of the fuel vapor recovery system for an internal combustion engine, the vapor recovery system having a canister fuel bowl vent valve, in accordance with the invention, incorporated therein; and, FIG. 2 is an enlarged sectional view of the canister fuel bowl vent valve, per se, of FIG. 1.

Referring first to FIG. 1, an internal combustion engine, not shown, has an induction system including a carburetor 2 having an induction passage 3 therethrough with flow through the induction passage controlled by throttle valve 4, with a conventional air cleaner 5 mounted on the carburetor. Induction fluid flowing through the induction passage 3 is delivered to an intake manifold 6 used to supply induction fluid to the combustion chambers, not shown, of the engine. Carburetor 2 is provided with a conventional fuel bowl 7 used for delivery, in a conventional manner, into the induction passage 3, fuel being supplied to the fuel bowl 7 from a fuel tank, not shown, in a conventional manner, with the level of fuel in the fuel bowl being controlled by a suitable float bowl valve, not shown. The carburetor is provided with an internal vent passage 8 which extends at one end from the upper end of the fuel bowl 7 to open at its other end into the interior of the air cleaner 5 on the clean side of the filter, not shown, therein, whereby fuel vapors from the fuel bowl are delivered directly to the induction fluid being delivered to the combustion chambers of the engine. The carburetor 2 is also provided with an external vent passage 10, also opening at one end into the interior of the fuel bowl at a position above the level of fuel therein, the opposite end of this passage 10 being connected, as by a conduit 11, to a fuel vapor canister 12 with flow of fuel vapor through the conduit 11 into the canister 12 being controlled by a canister fuel bowl vent valve, generally designated 14, constructed in accordance with the invention.

The fuel vapor canister 12 can be of any suitable type, for example, this canister may be of the type disclosed in U.S. Pat. No. 3,683,597 entitled "Evaporation Loss Control System" issued Aug. 15, 1972 to Thomas R. Beveridge and Ernst L. Ranft, such a canister containing a quantity of fuel vapor absorbing carbon therein and with the bottom of the canister being open to atmosphere so that air may be drawn through the carbon to purge the fuel vapor therefrom during engine operation in a manner as disclosed, for example, in the above-identified U.S. Pat. No. 3,683,597.

Referring now to FIG. 2, the fuel bowl vent valve 14, in the construction illustrated, includes a valve housing or body consisting of a base 15 providing a compartment or chamber therein, hereinafter referred to as chamber 16, with a central boss 17 therein and, an inverted cupshaped cover 18 suitably secured to the base 15. A flexible diaphragm 20 secured between the base 15 and the cover 18 defines a vacuum chamber 21 with the cover 18 and separates the vacuum chamber 21 from the chamber 16. Although the base 15 can be formed as a separate element, in the construction illustrated, it is formed as an integral part of the canister cover 22 which is secured to and encircles the upper open grid end 23 of the outer casing 24 of canister 12. The canister cover 22, outer casing 24, including its open grid end 23, and the cover 18 being molded, for example, from heat stabilized nylon.

The base 15 is provided with a side inlet port 25 which opens into an annular chamber 26 defined by the boss 17 and an inner annular wall 27 of the base 15 which encircles the boss 17 is spaced relation thereto and, base 15 is further provided with an outlet port 28 in communication at one end with the chamber 16 and which at its other end is suitably connected for communication with the interior of the canister 12. For example, in the construction illustrated, the outlet port 28 is placed in communication with the interior of the canister 12 via the openings extending through the open grid end 23 of outer casing 24, the structure of the open grid end 23 being similar to the corresponding structure shown in the above-identified U.S. Pat. No. 3,683,597.

Flow from the chamber 26 to the chamber 16 and therefore from the inlet port 25 to the outlet port 28, inlet port 25 and chamber 26 being referred to as the inlet for the vent valve and the outlet port and chamber 16 being referred to as the outlet for the vent valve, is controlled by a valve 30 having a stem 31 slidably received in a stem guide bore 32 extending through the boss 17, with a valve element or head 33 suitably fixed to one end of the stem 31 for movement therewith, in at least one axial direction, up as seen in FIG. 2, and which is positioned for engagement with an annular valve seat 34 encircling one end of the chamber 26, the lower end as seen in FIG. 2. At its opposite end, the stem 31 is fixed to the diaphragm 20 for movement therewith, this opposite end of the stem 31 extending through the central apertures in upper and lower diaphragm support plates 35 and 36, respectively, and a central aperture in the diaphragm 20, the diaphragm 20 being suitably sandwiched between these upper and lower diaphragm support plates.

The valve head 33 of valve 30 is normally biased toward an open or unseated position relative to the valve seat 34 by means of a coil spring 37 encircling the boss 17 with one end thereof in abutment against an inner flanged wall 38 of base 15 and its other end in abutment against the valve head 33.

For actuating the diaphragm 20 to effect closing movement of the valve 30 against the biasing action of the spring 37, the vacuum chamber 21 is supplied with induction manifold vacuum during engine operation via a port 40, having a flow control orifice 41 therein, that is provided in the cover 18, this port 40 being connected, as by a vacuum conduit 42, to a port 43 in the carburetor 2 that opens into the induction passage 3 downstream of the throttle valve 4, as shown in FIG. 1.

With this arrangement, the valve 30 is intended to be moved, as actuated by the diaphragm 20, toward a closed position relative to the valve seat 34, against the biasing action of spring 37, by engine manifold vacuum above a predetermined value and the valve 30 will open at vacuum signals below this predetermined manifold vacuum level, as a result of differential pressure acting on opposite sides of the diaphragm. The predetermined value of engine manifold vacuum above which closing movement of the valve 30 will occur is selected so that, in effect, during engine operation, the valve 30 is moved toward a closed position relative to the valve seat 34, this position being indicated by the broken line illustration of the valve head 33 in FIG. 2, while a vacuum signal below this predetermined level is, in effect, an engine off condition so that flow of vapors from the fuel bowl 7 to the canister 12 for storage therein occurs only when the engine is not operating. Thus during engine operation the vent valve 14 is closed so that fuel vapors from the fuel bowl are vented via the internal vent passage 8 to the engine in the manner described.

However, if the valve of the spring 37 and the effective operating areas of the diaphragm 20 and of the valve head 33, for example, of the valve structure thus far described are designed so that this valve will operate in the manner described above during engine operation at sea level, during engine operation at higher altitudes, the differential pressure across the diaphragm, as controlled by the engine manifold vacuum, except at idle, will be insufficient, in effect, maintain the valve 30, and specifically the valve head 33 thereof, in a closed position relative to the valve seat 34.

Now, in accordance with the invention, an electromagnet with external armature, specifically a portative type electromagnet, is incorporated into the structure of the vent valve 14 structure thus far above-described, this electromagnet hereinafter being referred to as a solenoid.

In the construction illustrated, the solenoid includes a circular magnetic flux producing coil assembly 45 which may be suitably fixed to the outer top of cover 18 or, as shown, suitably secured to the interior of the cover as by being positioned and fixed in the well 46 provided for this purpose in the cover. As shown, suitable terminals 47 extend from the coil assembly 45 out through the cover 18 whereby this coil assembly can be connected to the electrical system of the vehicle in a manner so that the coil assembly is energized during engine operation.

Thus, in the arrangement shown in FIG. 1, the terminals 47 are used to connect the coil assembly 45 into an electrical circuit which includes a source of electrical power such as battery B and with a normally open switch SW-1, such as an engine oil pressure actuated switch that would be closed during engine operation by the oil pressure in the engine's oil lubrication system in a well-known manner.

The solenoid also includes an external armature, in the form of a steel washer 48 which, in the construction illustrated, is supported on the upper diaphragm support plate 35 and is fixed to the valve stem 31 for movement therewith, as by having this washer 48, upper diaphragm support plate 35, diaphragm 20 and lower diaphragm support plate 36 sandwiched between the peened over upper end of the stem 31 and a radial shoulder of the stem 31 provided for this purpose.

As previously described, the solenoid is essentially in the form of a portative type electromagnet, that is, it is in the form of an electromagnet designed only for holding material, such as the steel washer 48 armature, that is brought into contact with the coil assembly 45 or sufficiently close thereto so as to be held by the magnetic flux field produced thereby. Stated in other words, when the coil assembly 45 is energized, the magnetic force exerted thereby on the steel washer, armature is not sufficient to attract this armature from its position when the valve 30 is open, the position shown in solid line in FIG. 2, since the gap between the steel washer 48 and the magnetic flux field produced by the energized coil assembly is too large.

However, when the vacuum pressure within the vacuum chamber 21, as during engine operation, is above a predetermined value, as previously described, so as to effect movement of the valve 30 to its closed position, the steel washer is moved to a second position, shown by broken lines in FIG. 2, a position which is closer to the magnetic flux field produced by the coil assembly 45, the magnetic force then exerted on the steel washer 48 armature is sufficiently greater, so that, once the steel washer armature is moved to this raised position, it will be held in this raised position as long as the coil assembly 45 is energized, thereby effecting latching the valve 30, during engine operation, in the closed position relative to the valve seat 34, irrespective of the vacuum pressure in chamber 21. Of course, when the engine is stopped, the switch SW-1 will resume its normal open position due to the loss of oil pressure in the engine, thereby de-energizing the coil assembly 45 to allow the spring 37 to again effect opening movement of the valve 30.

Thus during engine operation, it is the vacuum signal applied to the vacuum chamber 21 on one side of the diaphragm 20 which is operative to effect movement of the valve 30 to a closed position against the biasing action of the spring 37 and, with the engine operating, the oil pressure in the engine would be such so as to effect closure of the switch SW-1 to energize the coil assembly 45 whereby the solenoid is operative to keep the valve 30 in a latched closed position during continued engine operation. Thus, at altitude, although normal engine vacuum over the entire operating range of the engine would be insufficient to maintain the diaphragm positioned to keep the valve closed continually during engine operation, the vacuum at least at idle would, however, be sufficient to effect movement of the diaphragm to effect closure of the valve and then, with solenoid energized, it would be operative to retain the valve latched in this closed position as long as the engine is operating.

What is claimed is:

1. A fuel bowl vent valve for use with an internal combustion engine having a carburetor with an induction passage therethrough, a throttle valve controlling flow through the induction passage, a fuel bowl containing fuel up to a predetermined level therein and a fuel vapor passage opening from the fuel bowl above the level of fuel therein and, a vapor storage device; said fuel bowl vent valve, for controlling the flow of fuel vapor from the fuel bowl to the fuel vapor storage device, including a housing having an inlet connectable to the fuel vapor passage, and outlet for communication with the vapor storage device, said housing providing a cavity therein, a valve, including a stem and a head fixed to one end of said stem, supported in said housing for movement between a first position in which said head blocks fluid flow between said inlet and said outlet and a second position permitting fluid communication between said inlet and said outlet, a diaphragm positioned in said housing to divide said cavity into a vacuum chamber on one side thereof and a vapor chamber on the opposite side thereof, said vapor chamber being in fluid communication with said outlet, said diaphragm being operatively connected to the opposite end of said stem to effect movement of said valve, spring means operatively connected to said valve to normally bias said valve to said second position, a vacuum port in said housing opening at one end into said vacuum chamber and operatively connectable at its other end to the induction passage downstream of the throttle valve whereby during engine operation manifold vacuum can be applied to one side of said diaphragm to effect movement of said valve to said first position when manifold vacuum is above a predetermined value, a mangetic element operatively fixed to said one of said stem of said valve and an electromagnet fixed to said housing next adjacent to said vacuum chamber, said electromagnet being connectable to the electrical circuit of the engine via a normally open, engine oil pressure actuated switch, whereby during engine operation the switch is closed so that said electromagnet is energized to magnetically hold said magnetic element to retain said valve in said first position after said valve is moved to said first position by engine vacuum pressure, above said predetermined value, admitted to the vacuum chamber during engine operation.

2. A fuel bowl vent value for use in the fuel vapor recovery system for an internal combustion engine, the engine having an electrical circuit and a carburetor with a throttle controlled induction passage therethrough, the carburetor including a fuel bowl containing fuel to be supplied to the induction passage and having a fuel vapor storage passage extending therefrom, the fuel vapor recovery system including a storage device for fuel vapor; said fuel bowl vent valve including a housing, a diaphragm positioned in said housing to form therewith a vacuum chamber on one side of said diaphragm that is connectable to the induction passage downstream of the throttle and a vapor chamber on the opposite side of said diaphragm, said housing having an inlet means to said vapor chamber connectable to the fuel vapor storage passage and an outlet means from said vapor chamber connectable to the storage device, a spring biased, normally open, valve means operatively connected to said diaphragm and operatively positioned to control flow from said inlet means to said outlet means and, a portative type electromagnet means including an electromagnet operatively supported by said housing and an external armature operatively connected to said valve means, said electromagnet being operatively connectable to the electrical circuit of the engine whereby said electromagnet is energized during engine operation.

* * * * *

UNITED STATES PATENT AND TRADEMARK OFFICE

CERTIFICATE OF CORRECTION

PATENT NO. : 4,149,504

DATED : April 17, 1979

INVENTOR(S) : Leslie K. Walters

It is certified that error appears in the above-identified patent and that said Letters Patent are hereby corrected as shown below:

Column 6, line 24, "mangetic" should read -- magnetic --.

Column 6, line 25, after "one" insert -- end --.

Signed and Sealed this

*Eleventh* Day of *September 1979*

[SEAL]

*Attest:*

*Attesting Officer*

LUTRELLE F. PARKER

*Acting Commissioner of Patents and Trademarks*